United States Patent [19]

Butterworth et al.

[11] 4,403,927

[45] Sep. 13, 1983

[54] LUBRICANT DISTRIBUTION SYSTEM FOR SCROLL MACHINE

[75] Inventors: Arthur L. Butterworth, La Crosse; Robert E. Utter, South Onalaska, both of Wis.

[73] Assignee: The Trane Company, La Crosse, Wis.

[21] Appl. No.: 300,075

[22] Filed: Sep. 8, 1981

[51] Int. Cl.[3] ..... F01C 1/02; F01C 21/04; F01M 1/02; F01M 9/00

[52] U.S. Cl. ..... 418/55; 418/88; 184/6.3; 184/6.16; 184/11 R

[58] Field of Search ..... 418/55, 88; 184/6.3, 184/11 R, 11 A, 13, 6.16, 6.18

[56] References Cited

U.S. PATENT DOCUMENTS

| | | | |
|---|---|---|---|
| 3,587,780 | 6/1971 | Perriman | 184/6.3 |
| 3,767,013 | 10/1973 | Caldwell | 184/6.3 |
| 3,848,702 | 11/1974 | Bergman | 184/6.3 |
| 4,065,279 | 12/1977 | McCullough | 418/55 |
| 4,068,740 | 1/1978 | Quinn et al. | 184/11 R |

FOREIGN PATENT DOCUMENTS

| | | | |
|---|---|---|---|
| 55-64181 | 5/1980 | Japan | 418/55 |
| 56-9601 | 1/1981 | Japan | 418/55 |
| 308204 | 1/1956 | Switzerland | 184/6.18 |

*Primary Examiner*—John J. Vrablik

*Attorney, Agent, or Firm*—Carl M. Lewis; Ronald M. Anderson

[57] ABSTRACT

An oil distribution system for lubricating bearings in a scroll compressor. The system includes an oil collector cup attached to the lower surface of a swing link. Oil pumped through an internal passage in a rotating drive shaft is retained in the collector cup when the compressor stops, so that it is immediately available to lubricate adjacent bearings upon restart of the machine. Also disclosed in two embodiments are means for distributing and properly allocating the flow of oil between a thrust bearing and a swing link bearing.

10 Claims, 6 Drawing Figures

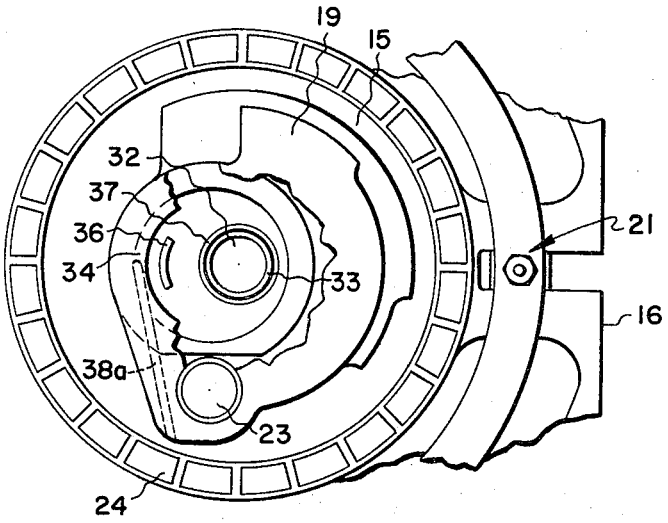
FIG. 3
FIG. 4
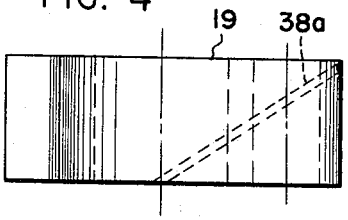
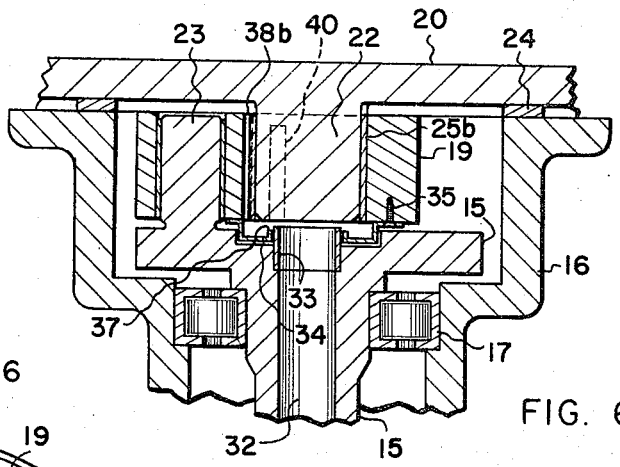
FIG. 6
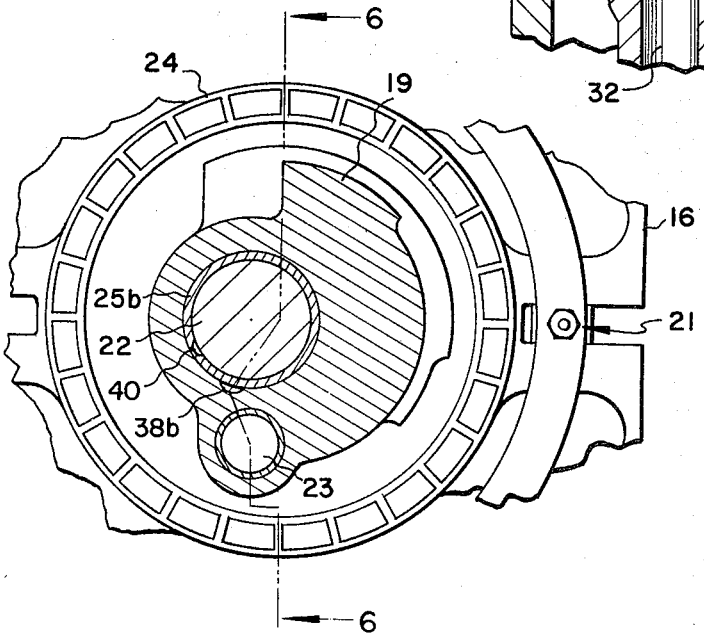
FIG. 5

LUBRICANT DISTRIBUTION SYSTEM FOR SCROLL MACHINE

TECHNICAL FIELD

This invention generally pertains to a lubricant distribution system for a scroll machine, and in particular to a system for distributing oil to the thrust and swing link bearings of a scroll machine.

BACKGROUND ART

The generic term "scroll machine" encompasses a class of positive fluid displacement apparatus which use orbiting involute spiral wraps formed on facing parallel plates to compress, expand, or pump a fluid. Although many designs for scroll machines exist in the prior art, very few have been successfully reduced to practice as commercially viable products. Some of the problems which have arisen in these development attempts are unique to the scroll machine, e.g., providing effective seals between the involute wraps and the end plates. However, other more common problems involving the efficiency and operating life of scroll machines must also be solved. For example, as in any mechanical device having moving parts subject to friction and wear, it is necessary to provide proper lubrication. In a scroll machine, an adequate lubricant supply is particularly important for the bearings associated with the rotating drive shaft and with the elements for converting the rotational motion of the shaft into the orbital motion of the scroll plates.

The lubrication system used in scroll machines and other rotating machinery having vertical drive shafts generally follow a similar pattern. Typically in such machines, oil flows from a reservoir located in either the lower or upper part of the machine housing, through oil passages drilled in the drive shaft, for distribution to the various components requiring lubrication. An example of such a scroll machine is disclosed in U.S. Pat. No. 4,065,279, wherein a centrifugal oil pump forces oil up through two eccentrically placed oil passages in a vertical drive shaft. One of these passages supplies oil to a series of grooves associated with a swing link journal bearing, thereby lubricating it and an adjacent thrust bearing. Oil flowing in the second internal passage of the drive shaft is distributed through a right angle passage for lubrication of the top journal bearing of the drive shaft. This design illustrates a problem common to scroll machines—providing adequate lubrication to the thrust, swing link, and drive shaft bearings—difficult due to the spacial separation of these bearings and their relatively dissimilar motion.

Laboratory tests of the lubrication system disclosed in the U.S. Pat. No. 4,065,279 patent have shown that the upper drive shaft journal bearing does not receive sufficient lubrication. This is believed due partly to an inadequate volumetric flow output from the centrifugal oil pump and partly to improper allocation of the oil flow between the drive shaft bearing and the other bearings. Allocation of oil between the thrust and swing link bearings is not a problem in the design of the U.S. Pat. No. 4,065,279 patent since oil for lubricating the thrust bearing first flows through the groove in the swing link bearing. However, where separate oil passages are used to supply oil to these bearings, the oil flow must be properly allocated between them.

A further problem noted in the lubrication of scroll machines concerns the lack of initial lubrication when such machines are restarted after a period of disuse. Typically, when a scroll machine stops operating, almost all of the lubricating oil drains down from the bearings and back into the reservoir. When the machine is restarted, oil is not available to lubricate bearing surfaces until it is distributed throughout the oil passages of the lubrication system. The longer and more tortuous the route which the oil must follow to reach these surfaces, the more likely it is that undesirable wear will occur, thereby shortening the operational life of the scroll machine.

In view of the foregoing discussion, it is therefore an object of this invention to provide an oil distribution and lubrication system for a scroll machine which minimizes wear of its bearings and prolongs its useful life.

It is a further object of this invention to properly distribute and allocate oil between the various bearings of a scroll machine.

A still further object of this invention is to make oil immediately available to lubricate bearings of the scroll machine when it is restarted after having been de-energized for a period of time.

These and other objects of the invention will become apparent from the description of the preferred embodiment which follows, and by reference to the attached drawings.

DISCLOSURE OF THE INVENTION

The subject invention is an oil distribution system for lubricating bearings of a scroll machine having a rotatably driven vertical shaft. The shaft includes an oil pump mounted upon its lower end, immersed in a reservoir of oil, and is provided with an internal oil passage through which oil is conveyed from the pump to the upper end of the shaft. A swing link, rotatably driven by the shaft, is mounted on its upper end.

An oil collector cup is disposed adjacent the swing link around the oil passage in the driven shaft. The collector cup rotates with the swing link and receives the oil flowing out of the oil passage in the shaft when the pump is operating. A small volume of oil is retained in the oil collector cup when the pump stops, and is immediately available to lubricate adjacent bearings of the scroll machine when the pump again starts.

The oil distribution system further includes oil distribution means for distributing oil from the oil collector cup to the adjacent bearings and allocating the flow of oil between the adjacent bearings in proper proportion. The oil distribution means includes one or more passages in fluid communication with the collector cup, which convey oil to bearings outside the swing link. Oil is thereby distributed to both a thrust bearing and a swing link bearing.

In one embodiment of the invention, the means for distributing oil further comprise an arcuate baffle disposed on the upper surface of the oil collector cup below the swing link bearing and extending upward toward it. This baffle acts to direct a portion of the oil in the oil collector cup vertically upward into the swing link bearing before it flows radially outward to the lower end of the one or more passages. The length of the baffle determines the relative proportion of oil flow distributed between the thrust bearing and the swing link bearing.

In a second embodiment, the swing link bearing is of the journal type, and the oil distribution means comprise a groove within the sliding surface of the swing link journal bearing, disposed in fluid communication with the oil collector cup at a point which is radially further from the axis of rotation of the shaft than the point where the passage(s) in the swing link is/are in fluid communication with the oil collector cup. Oil therefore tends to flow preferentially into the groove of the swing link journal bearing from a pool of oil accumulated at the periphery of the oil collector cup, due to the centrifugal force developed by the rotating shaft, rather than into the passage(s).

BRIEF DESCRIPTION OF THE DRAWINGS

FIG. 3 illustrates a cutaway plan view of the embodiment shown in FIG. 2.

FIG. 4 is a side view of the swing link, and shown the angle of the internal oil passage therein.

FIG. 5 shows in plan view, a second embodiment of the preferred invention, wherein the swing link contains a journal bearing.

FIG. 6 is a cross-sectional view taken along section line 6—6 of FIG. 5.

DESCRIPTION OF THE PREFERRED EMBODIMENTS

Figure 1:
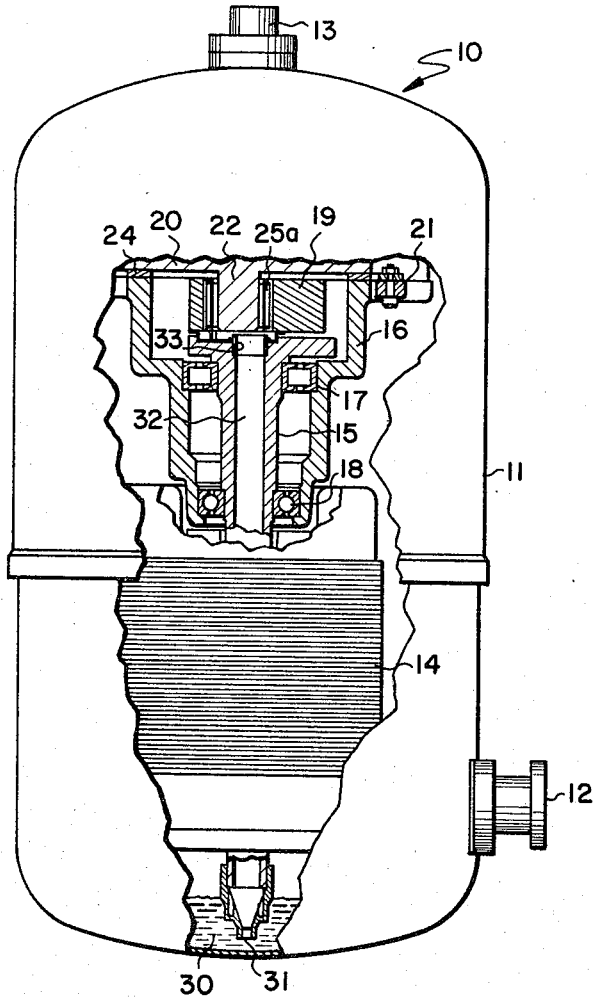
FIG. 1 is a cutaway view of a scroll machine, showing a preferred embodiment in cross-sectional aspect.

With reference to FIG. 1, a scroll machine configured as a refrigerant compressor is illustrated, and is generally denoted by reference numeral 10. Scroll compressor 10 includes a hermetic shell 11, having suction port 12 and discharge port 13 extending therethrough. An electric motor 14 provides the motive power for scroll compressor 10, and is cooled by suction gas entering through suction port 12.

The rotor of electric motor 14 includes a drive shaft 15 which extends vertically through scroll compressor 10. A bearing support 16 positions the upper end of drive shaft 15 in the hermetic shell 11, both axially and radially, by means of an upper rolling bearing 17 and a lower ball bearing 18.

The rotational motion of drive shaft 15 is transformed by means of a swing link 19 to the orbiting motion of an orbital scroll plate 20. The configuration of the orbiting scroll plate 20 and its associated stationary scroll member are not shown herein, nor will their operation be explained in any great detail. The principles by which scroll machines operate are well known to those skilled in the art and have been explained in numerous prior art patents, for example, U.S. Pat. No. 4,065,279. Since the functional operation of the involute scrolls is not particularly relevant to the subject invention, it should suffice to explain that a scroll machine either compresses, expands, or pumps, by causing pockets of fluid defined by the end plates and involute wraps of the orbiting and stationary scroll members to experience either a change in pressure or volume as the orbiting scroll member moves relative to the fixed scroll member. In the preferred embodiment, orbiting scroll plate 20 is constrained to orbit in a fixed angular relationship to the stationary scroll member by an Oldham coupling, generally denoted be reference numeral 21, as is well known in the art. (See FIGS. 2, 3, and 5.) A drive pin 22 extends downward from the lower surface of orbiting scroll plate 20, and it is about drive pin 22 that the swing link 19 rotates, being driven by a pivot pin 23 (shown in FIGS. 3, 5, and 6) on drive shaft 15. Pivot pin 23 extends upward from the top end of drive shaft 15, being eccentrically located off its longitudinal axis. Since drive pin 22 of the orbiting scroll plate 20 is also eccentrically located relative to the longitudinal axis of drive shaft 15, it should be apparent that rotation of drive shaft 15 results in a rotating radial force being applied to drive pin 22, causing its center to describe a circular orbit around the longitudinal axis of drive shaft 15.

Axial force is applied to the orbiting scroll 20 by means of thrust bearing 24. As shown in FIGS. 3 and 5, thrust bearing 24 includes a radial grooving pattern on its upper face to insure proper lubricant distribution across its sliding surfaces. An adequate flow of lubricating oil to these surfaces is essential to avoid excessive wear and frictional losses. Likewise, proper flow of lubricant to the swing link bearing **25*a* (in the first embodiment) and 25*b* (in the second embodiment) avoids excessive wear and rotational friction about drive pin 22, as the swing link 19 translates the rotational motion of drive shaft 15 into the orbiting motion of scroll plate 20**. Lubricating oil is distributed and properly apportioned to these key bearings by means which will hereinafter be discussed.

The void in the lower portion of hermetic shell 11 comprises an oil reservoir 30 in which an oil pump 31 is immersed. Oil pump 31 is attached to the lower extending end of drive shaft 15 for rotation thereby. The cnetrifugal force developed by rotation of oil pump 31 causes oil to move up an oil passage 32 bored through the interior of shaft 15 and out of a standpipe 33, which is fitted in the upper end. It will be apparent that the end of shaft 15 might be extended to form an integral stand pipe equivalent to the separate standpipe 33. The relatively large diameter of oil passage 32 and the overall high efficiency of centrifugal pump 31 combine to create a high volumetric flow of oil at the upper end of standpipe 33.

Oil exiting standpipe 33 is collected in an oil collector cup 34 which is attached to the lower surface of swing link 19 by bolts 35, or by other suitable attachment means. The dimensions of oil collector cup 34 are such that is slightly clears the upper end of drive shaft 15, as it rotates with swing link 19. A baffle 36 extends upward from the upper surface of oil collector cup 34 toward the bottom part of the swing link bearing **25*a*. Oil collector cup 34 is circular in shape, having an opening with an upward extending flange 37 disposed around standpipe 33, in a position which is eccentric to the center of the cup 34. The internal diameter of flange 37 is slightly larger than the exterior of standpipe 33, allowing cup 34 to freely rotate about standpipe 33**.

Figure 2:
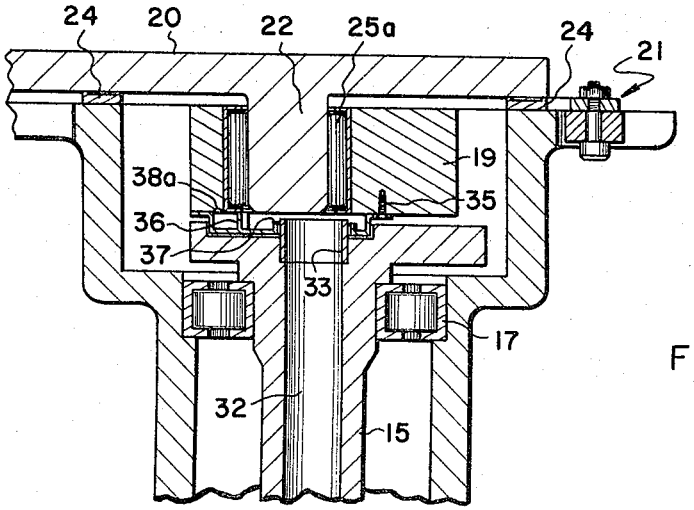
FIG. 2 is an enlarged view of the subject invention as shown in FIG. 1, illustrating one embodiment wherein the swing link bearing is of the rolling element type.

With reference to FIGS. 2 and 3, it can be seen that oil exiting standpipe 33 is thrown by centrifugal force away from the longitudinal axis of drive shaft 15. Accordingly, baffle 36 is disposed in the lobular portion of collector cup 34 immediately below the bearing **25*a*, as far from the axis of drive shaft 15 as possible, so that it intercepts a portion of the oil flowing from standpipe 33. Oil striking baffle 35 is thereby deflected upward and into the open end of the rolling element swing link bearings 25*a*. The upper end of baffle 36 is actually in contact with the extending lip of the outer race comprising roller bearings 25*a* to insure that the deflected oil stream is distributed into the rolling elements thereof. Oil which is not intercepted by baffle 36 flows behind it, accumulating in the lobular part of oil collector cup 34 furthest away from the longitudinal axis of drive shaft 15. From this point, in the first preferred embodiment, the oil flows through a swing link oil passage 38***a* bored at an angle through swing link 19. The lower open end of passage 38*a* is immediately above the oil collector cup where the pool of oil is collected, as shown in FIG. 2, and the upper end opens immediately adjacent thrust bearing 24.

It should be apparent that the length of arcuate baffle 36 determines the relative proportion of oil that is deflected thereby into the swing link rolling element bearing 25*a*, as compared to the oil which collects behind the baffle 36 and is available to flow through passage 38*a* for lubrication of the thrust bearing 24, i.e., as baffle 36 is made longer in length, more oil will be deflected into bearings 25*a*, with less being available for lubrication of the thrust bearing 24. However, if excessive oil is caused to flow into swing link roller bearing 25*a*, the resulting viscous losses in this bearing will reduce the overall efficiency of the scroll compressor 10. It is therefore essential that baffle 36 be made only long enough to provide adequate lubrication of swing link roller bearing 25*a*, but not so long as to introduce excessive oil, which would cause viscous losses.

Turning now to FIGS. 5 and 6, a second preferred embodiment of the subject invention is shown, wherein means are disclosed for distributing oil to a swing link journal bearing 25*b*. In the second embodiment, a passage 38*b* is provided in the wall of swing link 19, immediately adjacent the external surface of swing link journal bearing 25*b*, at a point which is generally adjacent to the pin 23. Oil passage 38*b* is substantially vertical, being aligned with the longitudinal axis of drive shaft 15. A substantially vertical groove 40 is formed in the internal wall of journal bearing 25*b* at a point which is radially closer to the longitudinal axis of rotation of the drive shaft 15 than is the point where the oil passage 38*b* through the swing link 19 communicates with the oil collector cup 34. As previously explained, oil exiting the stand tube 33 flows radially outward due to the centrifugal force developed by the rotation of drive shaft 15. Due to the eccentric location of the center point of the oil collector cup 34 relative to its axis of rotation, oil tends to accumulate in the lobular portion, flowing preferentially into groove 40 as compared to the swing link oil passage 38*b*. In this manner, the swing link journal bearing 25*b* is assured adequate lubrication, and yet a proportionate flow of the oil is further distributed through oil passage 38*b*, exiting from the top of the swing link 19, and thrown outward therefrom toward thrust bearing 24.

In both the first and second preferred embodiments herein disclosed, the oil passage 38 opens at the top of the swing link 19, near pivot pin 23. Laboratory tests have shown that oil leaving oil passage 38 from this position sprays onto the sliding surface on the bottom of the orbiting scroll plate 20 when that surface has moved radially inward of the thrust bearing 24 in its orbital path, so that a film of oil is thereby deposited onto the sliding surfaces for lubrication of these elements. If the oil spray reaches the orbiting scroll plate 20 at a point in time when its sliding surface has moved radially outward of the thrust bearing 24, the sliding surfaces are not exposed to the oil spray and are insufficiently lubricated, resulting in excessive friction and wear. The phase relationship between the impacting oil spray and the relative position of the orbiting scroll plate 20 remains fixed throughout the complete revolution of the swing link 19, since oil passage 38 rotates at the same frequency with which the scroll plate 20 orbits.

In addition to properly allocating and proportioning the flow of oil to the thrust bearing 24 and the swing link bearing 25, the subject invention provides immediate lubrication to these bearings when the scroll compressor 10 is re-energized after a period of disuse. Oil is retained in the collector cup 34 when the drive shaft 15 stops rotating, and does not drain back down into the oil reservoir 30. Typically, after prior art scroll machines are de-energized for a short time, relatively warm oil in the machine tends to drain back into the oil reservoir leaving the bearing surfaces with only a thin film of oil for lubrication when the machine is restarted. However, in the present invention, oil retained in the collector cup 34 is immediately available to lubricate the adjacent bearings as soon as drive shaft 15 again begins to rotate. This eliminates the delay of up to several seconds required for oil to rise from the oil reservoiir 30 to the bearings at the top of the scroll compressor 10. Although a single instance of running without adequate lubrication for several seconds of time may not result in significant damage to these bearings, wear accumulates as the machine is cycled on and off during its normal mode of operation. Immediate lubrication of these wearing parts upon startup of the scroll compressor 10 therefore substantially extends its operating life.

Bearing support 16 serves to channel excess oil thrown outward toward thrust bearing 24 from passage 38 back into reservoir 30, through upper drive shaft roller bearing 17 and lower drive shaft ball bearing 18. Since drive shaft bearings 17 and 18 are of the rolling element type, they do not require as much lubrication as would journal bearings. Part of the excess oil flows through ports (not shown) in bearing support 16 and back into reservoir 30 along the exterior surface of support 16. Oil which has lubricated thrust bearings 24 and passed radially outward therethrough also returns to reservoir 30 along the exterior surface of bearing support 16.

As disclosed in the first embodiment of the subject invention, oil passage 38*a* in the swing link 19 extends from a point above the oil collector cup 34 to a point adjacent pivot pin 23. It is also comtemplated that a radially extending passage 38*a* could be provided comprising an external tube for directing the flow of oil to the thrust bearing 24 at a point where it would properly lubricate this bearing as it rubs against the lower portion of the orbiting scroll plate 20. Furthermore, thrust bearing 24 might be replaced with a rotating ball bearing assembly such that it would not be necessary to direct the oil flow toward a particular part of the orbiting scroll plate 20 in order to insure its adequate lubrication. Such a ball bearing replacement for thrust bearing 24 would have a relatively open cage and would not be affected by the phasal position inherent in the sliding action of thrust bearing 24 against the underside of orbiting scroll plate 20. It will be understood that modifications such as these will be apparent to those skilled in the art within the scope of the invention, as defined in the claims which follow.

We claim:

1. An oil distribution system for lubricating bearings of a scroll machine, comprising a rotatably driven vertical shaft having an oil pump on its lower end extending into a reservoir of oil, and including an internal oil passage through which oil is conveyed from the pump to the upper end of the shaft on which is mounted a swing link rotatably driven by the shaft;

an oil collector cup disposed adjacent the swing link, around the oil passage in said driven shaft and rotatably driven by the shaft, in receipt of oil flowing out of the oil passage in the shaft when the pump is operating, and operative to retain a small volume of oil when the pump stops so that the oil retained is immediately available to lubricate adjacent bearings of the scroll machine when the pump again starts; and oil distribution means for distributing oil from the oil collector cup to the adjacent bearings including a thrust bearing and a swing link bearing and allocating the flow of oil between the adjacent bearings in proper proportion to insure adequate lubrication thereof, said oil distribution means including one or more passages in fluid communication with the collector cup for conveying oil to bearings outside the swing link.

2. In a scroll maching having a thrust bearing, a swing link with an associated bearing, and a vertical rotating drive shaft for rotating the swing link and provided with an oil passage through which oil is conveyed from a reservoir by a pump, a lubricating oil distribution system comprising:

an oil collector cup, depending from the bottom of the swing link and disposed around the upper end of the drive shaft in fluid communication with its oil passage, said oil collector cup being operative to retain oil collected therein when the drive shaft stops rotating so that when the drive shaft again begins to rotate, the retained oil is immediately available for lubrication of the thrust and swing link bearings;

one or more passages in fluid communication with the oil collector cup, disposed within the swing link, the upper end of at least one of the passages disposed radially inward of the thrust bearing, so that centrifugal force developed by roatation of the drive shaft forces oil upward from the collector cup through at least the one passage and slings it radially outward toward the thrust bearing; and means for distributing oil from the collector cup to the swing link bearing in proper proportion to the flow of oil to the thrust bearing to insure adequate lubrication of the bearings.

3. In a scroll machine having a vertical rotating drive shaft provided with an oil passage through which oil is conveyed from a reservoir by a centrifugal pump drivingly rotated by the shaft, a lubricating oil distribution system for properly allocating the flow of oil between a thrust bearing and a bearing associated with a swing link rotatably driven by the drive shaft, said oil distribution system comprising an oil collector cup, depending from the bottom of the swing link in circumscribing relationship to the upper end of the oil passage in the drive shaft, said oil collector cup being operative to retain oil collected therein when the drive shaft stops rotating the centrifugal pump, so that when the drive shaft again begins to rotate the pump, the retained oil is immediately available for lubricating the thrust and swing link bearings;

one or more passages in fluid communication with the oil collector cup, disposed within the swing link and adjacent its bearings, the upper end of at least one of the passages disposed radially inward of the thrust bearing so that oil pumped into the collector cup is conveyed upward through the one or more passages and radially outward toward the thrust bearing; and means for distributing the oil and apportioning the flow thereof to the swing link bearing in proper proportion to the flow of oil to the thrust bearing through at least one said passage so that each of said bearings is properly lubricated.

4. The oil distribution system of claims 1, 2, or 3 wherein the means for distributing oil comprise an arcuate baffle disposed on the upper surface of the oil collector cup below the swing link bearing and extending upward theretoward, said baffle acting to direct a portion of the oil in the oil collector cup vertically upward into the swing link bearing before it flows radially outward to the lower end of the one or more passages, the length of the baffle thereby determining the relative proportion of oil flow between the thrust bearing and the swing link bearing.

5. The oil distribution system of claim 4 wherein the swing link bearing is of the rolling element type and the baffle is sufficiently short in length to provide just enough oil flow to adequately lubricate the rolling elements without causing excessive viscous losses.

6. The oil distribution system of claims 1, 2, or 3 wherein the swing link bearing is of the journal type.

7. The oil distribution system of claim 6 wherein the means for distributing oil further comprise a groove within the sliding surface of the swing link journal bearing and disposed in fluid communication with the oil collector cup at a point which is radially further from the axis of rotation of the shaft than the point where at least said one passage in the swing link is in fluid communication with the oil collector cup, whereby oil tends to flow preferentially into the groove of the swing link journal bearing from a pool of oil accumulated at the periphery of the oil collection cup due to the centrifugal force developed by the rotating shaft, rather than into at least said one passage.

8. The oil distribution system of claim 7 wherein excess oil provided to the swing link journal bearing by means of the groove exits the top of the journal bearing and is thrown radially outward toward the thrust bearing.

9. The oil distribution system of claims 1, 2, or 3 wherein the oil collector cup is generally circular shaped about a center point which is offset from the longitudinal axis of the rotating shaft, an off-center circular opening being provided in the oil collector cup of slightly larger diameter than that of the rotating shaft, the circumferential edge of said circular opening including a flange which loosely abuts the outer surface of the rotating shaft.

10. The oil distribution system of claims 1, 2, or 3 wherein the oil collector cup is bolted to the swing link.

* * * * *